US009592591B2

(12) United States Patent
McClung

(10) Patent No.: US 9,592,591 B2
(45) Date of Patent: Mar. 14, 2017

(54) IMPACT TOOLS WITH SPEED CONTROLLERS

(71) Applicant: Ingersoll-Rand Company, Davidson, NC (US)

(72) Inventor: Mark T. McClung, Andover, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 489 days.

(21) Appl. No.: 14/099,226

(22) Filed: Dec. 6, 2013

(65) Prior Publication Data

US 2015/0158165 A1 Jun. 11, 2015

(51) Int. Cl.

| | |
|---|---|
| ***B25D 9/16*** | (2006.01) |
| ***B25B 19/00*** | (2006.01) |
| ***B25B 21/02*** | (2006.01) |
| ***B25B 23/145*** | (2006.01) |

(52) U.S. Cl.

CPC ..... *B25B 19/00* (2013.01); *B25B 21/02* (2013.01); *B25B 23/1453* (2013.01)

(58) Field of Classification Search

CPC ..... B25B 19/00; B25B 21/02; B25B 21/007; B25B 21/023

USPC ..... 173/90, 93, 94, 168, 169, 218, 219

See application file for complete search history.

(56) References Cited

U.S. PATENT DOCUMENTS 2,768,546 A 10/1956 Amtsberg
3,071,115 A * 1/1963 Schott ..... F01C 20/08 418/42
3,174,597 A 3/1965 Schaedler et al.
3,465,646 A * 9/1969 Kiester ..... F01C 1/344 418/69
3,708,240 A * 1/1973 Theis, Jr. ..... A61C 1/0007 137/56

(Continued)

FOREIGN PATENT DOCUMENTS

| | | |
|---|---|---|
| EP | 2388107 A2 | 11/2011 |
| GB | 540239 | 10/1941 |
| GB | 546372 | 7/1942 |

OTHER PUBLICATIONS

"Air Pro Quality Air Tools . . . Impact Wrenches," downloaded from http://www.justools.com/catalog/images/uploads/catalogue.pdf on Jun. 19, 2013, 6 pages.

(Continued)

*Primary Examiner* — Nathaniel Chukwurah

(74) *Attorney, Agent, or Firm* — Barnes & Thornburg LLP

(57) ABSTRACT

Illustrative embodiments of impact tools with speed controllers and methods of controlling such impact tools are disclosed. In at least one illustrative embodiment, an impact tool may comprise a ball-and-cam impact mechanism including a hammer and an anvil. The hammer may be configured to rotate about a first axis and to translate along the first axis to impact the anvil to cause rotation of the anvil about the first axis. The impact tool may further comprise a motor and a speed controller. The motor may include a rotor configured to rotate when a flow of compressed fluid is supplied to the rotor to drive rotation of the hammer of the ball-and-cam impact mechanism. The speed controller may be coupled to the rotor and may be configured to throttle the flow of compressed fluid supplied to the rotor based on a rotational speed of the rotor.

15 Claims, 4 Drawing Sheets

(56) References Cited

U.S. PATENT DOCUMENTS

| | | | | |
|---|---|---|---|---|
| 4,057,113 | A * | 11/1977 | Paule | B23B 45/04 137/53 |
| 4,243,108 | A | 1/1981 | Galimov et al. | |
| 4,465,443 | A * | 8/1984 | Karden | B24B 55/00 137/50 |
| 4,740,144 | A * | 4/1988 | Biek | B25B 21/00 418/266 |
| 4,919,022 | A | 4/1990 | Ono et al. | |
| 5,005,682 | A | 4/1991 | Young et al. | |
| 5,544,710 | A | 8/1996 | Groshans et al. | |
| 8,317,350 | B2 | 11/2012 | Friedman et al. | |
| 2008/0190635 | A1 * | 8/2008 | Nelson | B24B 23/026 173/219 |
| 2011/0139474 | A1 | 6/2011 | Seith et al. | |
| 2011/0236180 | A1 * | 9/2011 | Nelson | F01C 13/02 415/1 |
| 2012/0211249 | A1 * | 8/2012 | Seith | B25B 21/026 173/94 |

OTHER PUBLICATIONS

Ingersoll-Rand Co., "2015 MAX 3/8 Impact Wrench," downloaded from http://www.ingersollrandproducts.com/am-en/products/tools/impactools/maintenance-automotive-impactools/3-8-drive/2015max-3-8-impact-wrench on Apr. 28, 2014, 1 page.

* cited by examiner

IMPACT TOOLS WITH SPEED CONTROLLERS

TECHNICAL FIELD

The present disclosure relates, generally, to impact tools and, more particularly, to impact tools with speed controllers.

BACKGROUND

An impact wrench is one illustrative embodiment of an impact tool, which may be used to install and remove threaded fasteners. An impact wrench generally includes a motor coupled to an impact mechanism that converts the torque of the motor into a series of powerful rotary blows directed from one or more hammers to an anvil coupled to an output shaft. In a ball-and-cam type impact mechanism, the hammer both rotates about an axis and translates along that axis to impact the anvil. The translation of the hammer (and, hence, the timing of the impacts with the anvil) is mechanically controlled by one or more balls disposed in cam grooves formed between the hammer and a camshaft, as well as a spring that biases the hammer. As the components of a ball-and-cam impact mechanism are typically designed for optimal operation at a particular rotational speed of the hammer, impact tools with ball-and-cam impact mechanisms often utilize electric motors to drive rotation.

SUMMARY

According to one aspect, an impact tool may comprise a ball-and-cam impact mechanism comprising a hammer and an anvil, where the hammer being configured to rotate about a first axis and to translate along the first axis to impact the anvil to cause rotation of the anvil about the first axis, a motor including a rotor configured to rotate when a flow of compressed fluid is supplied to the rotor to drive rotation of the hammer of the ball-and-cam impact mechanism, and a speed controller coupled to the rotor and configured to throttle the flow of compressed fluid supplied to the rotor based on a rotational speed of the rotor.

In some embodiments, the impact tool may include an orifice through which the flow of compressed fluid passes, and the speed controller may be configured to throttle the flow of compressed fluid supplied to the rotor by regulating a size of the orifice. The speed controller may comprise a plunger movable to reduce the size of the orifice, a spring biasing the plunger away from the orifice, and one or more masses configured to exert a force on the plunger, in response to rotation of the rotor, to overcome the spring bias. The speed controller may further comprise one or more ramped surfaces in which the one or more masses are in contact with the one or more ramped surfaces and with the plunger, and the one or more masses may be configured to move up the one or more ramped surfaces in response to centripetal forces resulting from rotation of the rotor. In some embodiments, the rotor may be configured to rotate about a second axis, the plunger may be configured to translate along the second axis to move into the orifice, and the one or more ramped surfaces may be disposed at an acute angle to the second axis.

In some embodiments, the rotor may be configured to rotate about a second axis that is nonparallel to the first axis. The impact tool may further comprise a drive train configured to transmit rotation from the rotor to the hammer of the ball-and-cam impact mechanism. The drive train may comprise a first bevel gear configured to rotate about an axis parallel to the first axis and a second bevel gear configured to rotate about an axis parallel to the second axis such that the first bevel gear meshes with the second bevel gear. In some embodiments, the rotor may comprise a first end coupled to the drive train and a second end coupled to the speed controller such that the second end is opposite the first end. The speed controller may be configured to rotate with the rotor. The anvil may be integrally formed with an output shaft of the impact tool.

According to another aspect, a method of controlling an impact tool including a motor and a ball-and-cam impact mechanism may comprise supplying a flow of compressed fluid through an orifice of the impact tool to cause a rotor of the motor to rotate about a first axis, such that rotation of the rotor drives rotation of a hammer of the ball-and-cam impact mechanism, and regulating a size of the orifice, using a speed controller coupled to the rotor, based on a rotational speed of the rotor.

In some embodiments, the rotor may drive rotation of the hammer through a drive train coupled between the rotor and the ball-and-cam impact mechanism and the drive train may include a set of bevel gears. The hammer may rotate about a second axis that is nonparallel to the first axis. Regulating the size of the orifice may comprise reducing the size of the orifice by a first amount in response to the rotational speed of the rotor being a first speed and reducing the size of the orifice by a second amount greater than the first amount in response to the rotational speed of the rotor being a second speed greater than the first speed. Additionally or alternatively, regulating the size of the orifice may comprise moving a plunger to reduce the size of the orifice. Moving the plunger may comprise exerting a force on the plunger using one or more masses to overcome a spring bias. Centripetal forces resulting from rotation of the rotor may cause the one or more masses to exert the force on the plunger.

According to yet another aspect, an impact tool may comprise an impact mechanism coupled to an output shaft, a motor including a rotor configured to rotate when a flow of compressed fluid is supplied to the rotor to drive the impact mechanism, one or more masses configured to rotate in response to rotation of the rotor, and a plunger configured to throttle the flow of compressed fluid supplied to the rotor based on a rotational speed of the one or more masses. In some embodiments, the one or more masses may exert a force on the plunger that is a function of the rotational speed of the one or more masses.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure. Unless otherwise specified, the terms "coupled," "mounted," "connected," "supported," and variations thereof are used broadly and encompass both direct and indirect couplings, mountings, connections, and supports.

Figure 1:
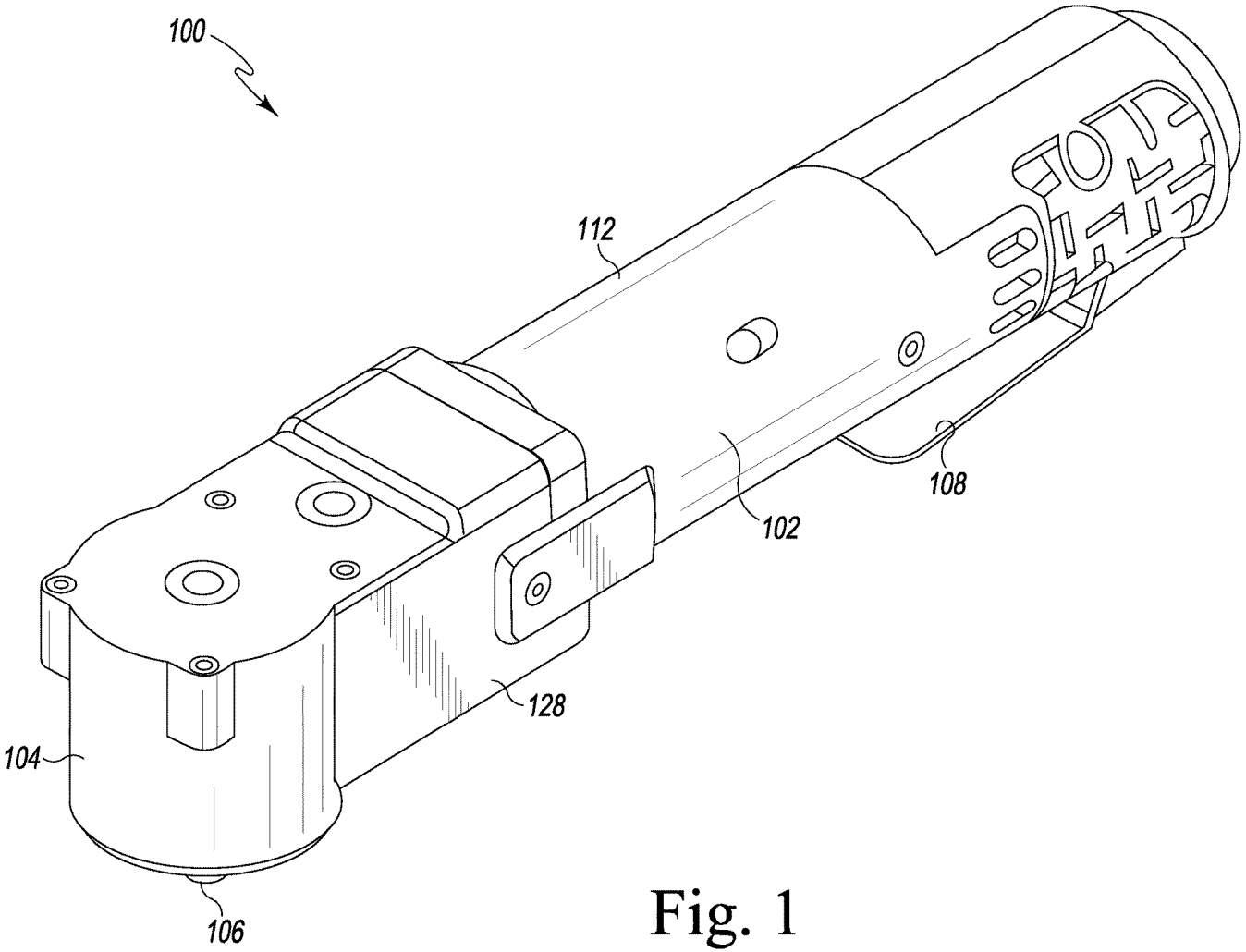
FIG. 1 is a perspective view of one illustrative embodiment of an impact tool.
Figure 2:
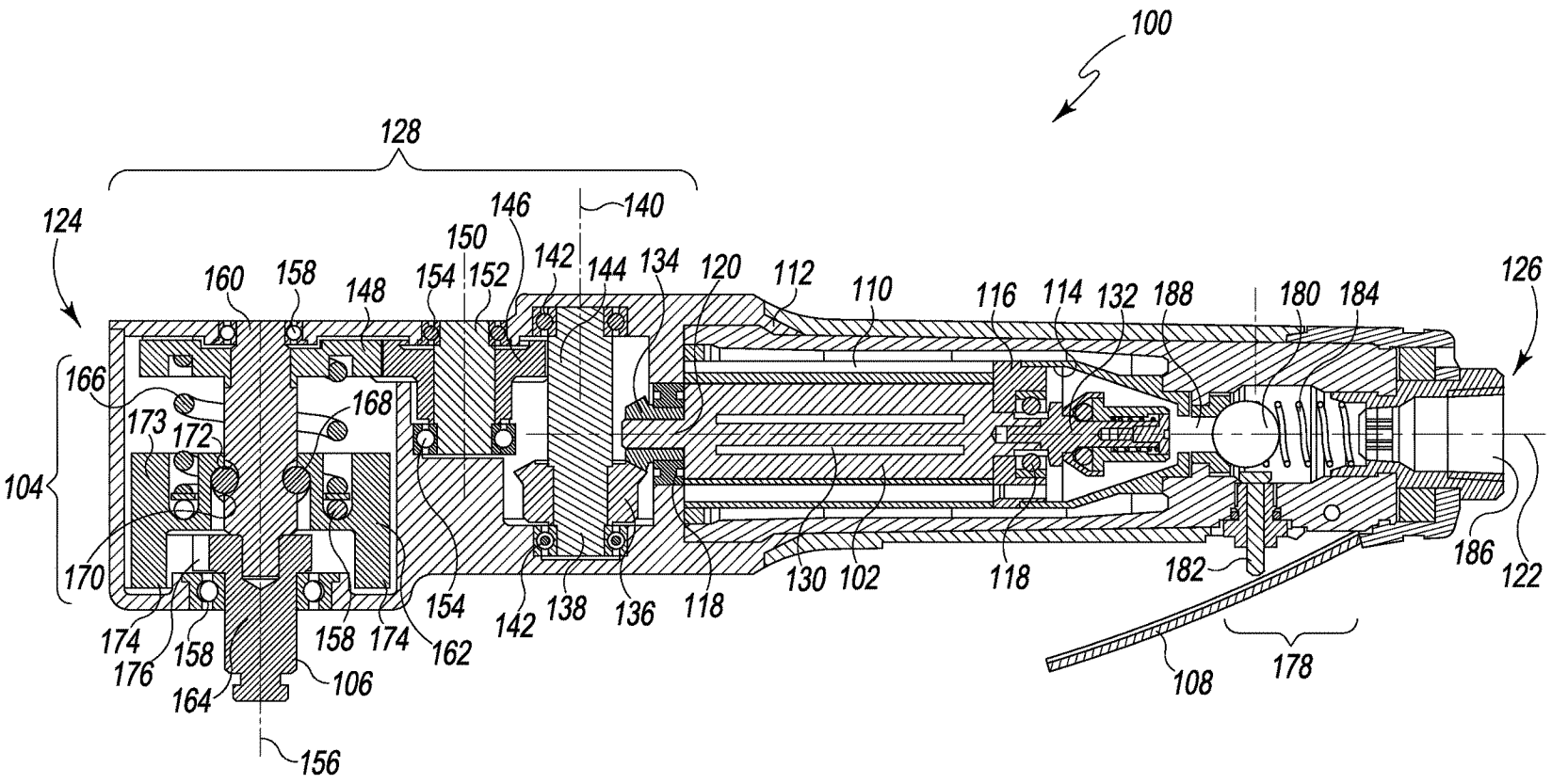
FIG. 2 is a cross-sectional view of the impact tool of FIG. 1.
Figure 3:
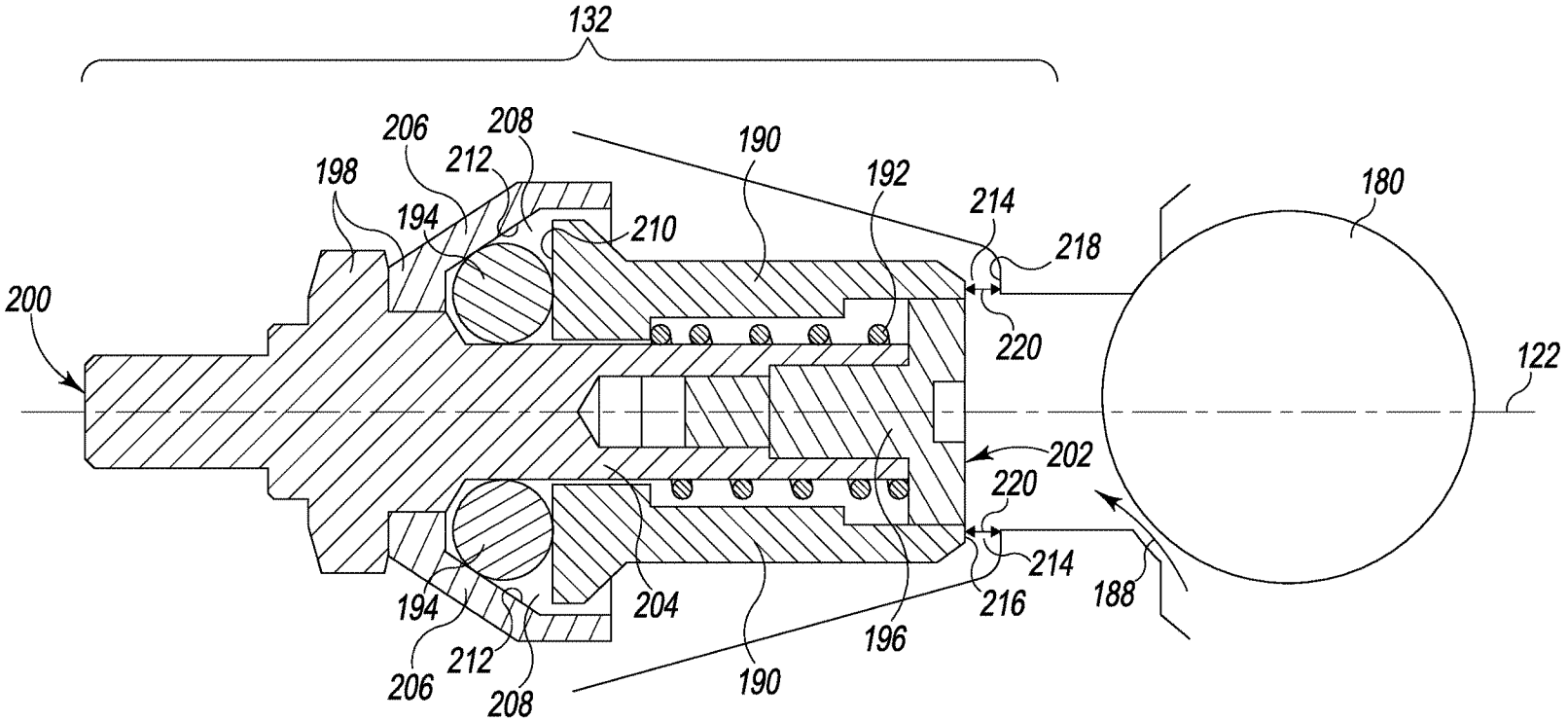
FIG. 3 is a detailed cross-sectional view of a speed controller of the impact tool of FIG. 1.

Referring now to FIGS. 1-3, perspective and cross-sectional views of one illustrative embodiment of an impact tool 100 are shown. The impact tool 100 allows a ball-and-cam impact mechanism to operate properly when driven by a motor powered by a compressed fluid. More specifically, the impact tool 100 utilizes a speed controller to regulate the speed of the motor to maintain proper operation of the ball-and-cam impact mechanism. The impact tool 100 is shown as a right-angle impact tool in the illustrative embodiment of FIGS. 1-3; however, in other embodiments, the impact tool 100 may have a pistol-grip or other suitable configuration.

The impact tool 100 includes a motor 102 configured to drive rotation of an impact mechanism 104 and thereby drive rotation of an output shaft 106 in response to activation of a trigger 108 (e.g., by a user) of the impact tool 100. The motor 102 is illustratively embodied as a pneumatically powered motor (i.e., an air motor) positioned within an internal cavity 110 of a housing 112 of the impact tool 100. In the illustrative embodiment of FIGS. 1-3, the motor 102 is secured to an inner wall 114 of the housing 112 with motor endplates 116 and bearings 118. The motor endplates 116 securely hold the motor 102 in place to prevent undesired movement of the motor 102 within the internal cavity 110 of the housing 112 (e.g., from vibrations of the motor 102). It will be appreciated that, in other embodiments, other mechanisms for securing the motor 102 may be used. U.S. Pat. No. 7,886,840 to Young et al., the entire disclosure of which is hereby incorporated by reference, describes at least one embodiment of an air motor that may be used as the motor 102 of the impact tool 100. It is also contemplated that, in other embodiments of the impact tool 100, the motor 102 may be embodied as another type of fluid-powered motor.

The motor 102 includes a rotor 120 positioned along a longitudinal axis 122 of the impact tool 100. As illustratively shown, the longitudinal axis 122 extends from a front end 124 of the impact tool 100 to a rear end 126 of the impact tool. In the illustrative embodiment of FIGS. 1-3, where the motor 102 is embodied as an air motor, the rotor 120 includes a plurality of vanes 130 that are configured to be driven by a supply of motive fluid (e.g., compressed air). Further, a front end of the rotor 120 is operably coupled to a drive train 128 such that rotation of the rotor 120 is transferred to the drive train 128 (e.g., through rotation of one or more gears of the drive train 128), which is operably coupled to the impact mechanism 104. A back end of the rotor 120 is coupled to a speed controller 132 that is configured to regulate the rotational speed of the rotor 120.

In the illustrative embodiment of FIGS. 1-3, the drive train 128 includes a bevel gear set comprising a bevel gear 134 and a bevel gear 136. The bevel gear 134 is coupled to the rotor 120 for rotation with the rotor 120 about the longitudinal axis 122. The bearings 118 are positioned between the bevel gear 134 and the housing 112. The bevel gear 136 meshes with the bevel gear 134. The bevel gear 136 is coupled to a shaft 138 for rotation with the shaft 138 about an axis 140. The shaft 138 is supported in the housing 112 by bearings 142. The shaft 138 includes a splined portion 144 that functions as a spur gear. In some embodiments, the splined portion 144 of the shaft 138 may instead be embodied as a spur gear coupled to the shaft 138 for rotation about the axis 140.

In the illustrative embodiment, the drive train 128 includes a spur gear set comprising the splined portion 144 of the shaft 138, an idler spur gear 146, and a drive spur gear 148. Rotation of the splined portion 144 of the shaft 138 causes rotation of the idler spur gear 146 about an axis 150. The idler spur gear 146 is coupled to a shaft 152 for rotation with the shaft 152 about the axis 150. The shaft 152 is supported in the housing 112 by bearings 154. The idler spur gear 146 meshes with a drive spur gear 148 to cause rotation of the drive spur gear 148 about an axis 156. The drive spur gear 148 is coupled to the output shaft 106 through the impact mechanism 104 for rotating the output shaft 106. The drive spur gear 148 and the output shaft 106 are supported for rotation within the housing 112 by bearings 158.

In the illustrative embodiment of FIGS. 1-3, the axes 140, 150, and 156 are all substantially parallel to each other and are all substantially perpendicular to the longitudinal axis 122. It is contemplated that, in other embodiments, one or more of the axes 140, 150, and 156 may be oriented at another angle relative to the longitudinal axis 122. It will be appreciated that, in other embodiments, the drive train 128 may include additional, fewer, or different gears than those shown in the illustrative embodiment of FIG. 2. Depending on the particular embodiment, the drive train 128 may include, for example, ring gears, planetary gears, spur gears, bevel gears, belts, worm gears, other gears, or any combination thereof that may be used to transfer torque from the motor 102 to the impact mechanism 104 and thereby drive rotation of the impact mechanism 104.

As discussed above, in the illustrative embodiment, the impact mechanism 104 of the impact tool 100 is embodied as a ball-and-cam type impact mechanism. As shown in FIG. 2, the impact mechanism 104 generally includes a camshaft 160, a hammer 162, an anvil 164, and a spring 166. The camshaft 160 is coupled to the drive spur gear 148 for rotation with the drive spur gear 148 about the axis 156. The camshaft 160 passes through an opening in the hammer 162 (e.g., at the center of the hammer 162) and is coupled to the hammer 162 through one or more balls 168. The hammer 162 is rotatable over the balls 168 and is driven for rotation about the axis 156 by the rotation of the camshaft 160. The hammer 162, in turn, drives rotation of the anvil 164 about the axis 156 (i.e., in response to the hammer 162 impacting the anvil 164). It will be appreciated that the shape, location, and number of the bearings in the impact tool 100 and, more particularly, in the impact mechanism 104 may vary depending on the particular embodiment. For example, in the illustrative embodiment, the bearings about which the hammer 162 is rotatable include balls 168 configured to be received in corresponding recesses 170 formed in the hammer 162. The camshaft 160 includes one or more cam grooves 172 (e.g., a pair of helical grooves) that define pathways for the balls 168. That is, in the illustrative embodiment, the balls 168 are positioned in the cam grooves 172 and the corresponding recesses 170 of the hammer 162 to couple the camshaft 160 to the hammer 162.

As indicated above, the hammer 162 rotates about the axis 156 and translates along the axis 156 to impact the anvil 164, thereby driving rotation of the anvil 164 about the axis 156. In some embodiments, the anvil 164 may be integrally formed with the output shaft 106. In other embodiments, the anvil 164 and the output shaft 106 may be formed separately and coupled to one another (e.g., by a taper fit or other fastening mechanism). In such embodiments, the output shaft 106 is configured to rotate as a result of the corresponding rotation of the anvil 164. The output shaft 106 is configured to mate with a socket (e.g., for use in tightening and loosening fasteners, such as bolts). Although the output shaft 106 is shown as a square drive output shaft, the principles of the present disclosure may be applied to an output shaft of any suitable size and shape. The motor 102, the drive train 128, and the impact mechanism 104 (which includes the hammer 162 and the anvil 164) are adapted to rotate the output shaft 106 in both clockwise and counterclockwise directions, for tightening or loosening various fasteners.

The hammer 162 includes a pair of lugs 174 extending from an impact face of the hammer 162. Each of the lugs 174, which are integrally formed with a body 173 of the hammer 162, includes an impact surface configured to impact a corresponding impact surface of the anvil 164. The anvil 164, which may be integrally formed with the output shaft 106, includes a pair of lugs 176 (one being illustratively shown in FIG. 2) extending radially outwardly from the output shaft 106. Each of the lugs 176, which may be integrally formed with the anvil 164, includes an impact surface for receiving an impact blow from the lugs 174 of the hammer 162. Although each of the hammer 162 and the anvil 164 includes two lugs 174, 176 in the illustrative embodiment, any suitable number of lugs 174, 176 may be utilized in other embodiments.

The spring 166 is disposed around the camshaft 160 between the hammer 162 and the drive spur gear 148 to bias the hammer 162 away from the drive spur gear 148 (i.e., toward an engaged position). In other words, the spring 166 moves the hammer 162 along the cam grooves 172 of the camshaft 160, toward the anvil 164, to provide a clearance between the hammer 162 and the drive spur gear 148. It will be appreciated that the spring 166 moves the hammer 162 toward the anvil 164 by virtue of applied spring forces of the compressed spring 166 (i.e., the conversion of potential energy stored in the compressed spring 166 into kinetic energy). In the engaged position, the lugs 174 impact the lugs 176 to transfer rotational torque from the hammer 162 to the anvil 164.

When the hammer 162 impacts the anvil 164, a rebounding force from the impact causes the hammer 162 to angularly rebound in a direction opposite the direction of rotation. By virtue of the coupling between the camshaft 160 and the hammer 162, the angular movement (i.e., rotation) of the hammer 162 also causes axial movement of the hammer 162. As such, the hammer 162 is driven toward the drive spur gear 148 by virtue of the rebounding force from the impact (i.e., toward a disengaged position). As the hammer 162 rebounds, the lugs 174 of the hammer 162 are separated from the lugs 176 of the anvil 164 so that the lugs, 174, 176 do not contact one another, despite rotation of the hammer 162. Additionally, as the hammer 162 is driven backward toward the drive spur gear 148, the spring 166 is compressed (i.e., the biasing force is overcome) and the clearance between the hammer 162 and the drive spur gear 148 is reduced.

The impact tool 100 further includes a trigger mechanism 178, which is configured to selectively supply motive fluid to the motor 102. In the illustrative embodiment, the trigger mechanism 178 includes the trigger 108, a valve 180, a pin 182, and a spring 184. The valve 180 is configured to move between a open position (shown in FIG. 3), in which motive fluid is supplied from a fluid inlet 186 (e.g., connected via a hose to a user's compressed air supply unit) to the motor 102 through a passageway 188, and a closed position (shown in FIG. 2), in which the valve 180 prevents motive fluid from reaching the motor 102. The spring 184 is configured to bias the valve 180 toward the front end 124 of the impact tool 100 to close the valve 180. Although the valve 180 is depicted as a ball valve in the illustrative embodiment, the valve 180 may be embodied as any suitable type of valve, such as a tip valve, in other embodiments. In the illustrative embodiment, the user depresses the trigger 108, which forces the pin 182 to overcome the biasing force of the spring 184 to deflect the valve 180 from the closed position to permit passage of motive fluid from the fluid inlet 186 through the passageway 188.

As discussed above, the back end of the rotor 120 is coupled to a speed controller 132 that is configured to regulate the rotational speed of the rotor 120. In the illustrative embodiment shown in FIGS. 2-3, the speed controller 132 includes a plunger 190, a spring 192, one or more masses 194 (e.g., ball bearings), a retention screw 196, and a controller body 198. The controller body 198 is coupled to the rotor 120 at a front end 200 of the speed controller 132 for rotation with the rotor 120 about the longitudinal axis 122. As shown in FIG. 3, the controller body 198 comprises a cylindrical body 204 extending from the front end 200 to the back end 202 along the longitudinal axis 122 and a ramped body 206 extending outward from the cylindrical body 204. In the illustrative embodiment, the cylindrical body 204 and the ramped body 206 are secured to one another via a press fit. In other embodiments, the cylindrical body 204 and the ramped body 206 may be secured via another suitable fastening mechanism (e.g., a taper fit) or may be integrally formed as a unitary controller body 198.

The ramped body 206 includes one or more recesses 208 defined therein to secure the one or more masses 194. In the illustrative embodiment, the plunger 190 is disposed around the cylindrical body 204 and includes a contact surface 210 shaped to fit in the recesses 208 of the ramped body 206 to contact the masses 194. The spring 192 of the speed controller 132 is disposed around the cylindrical body 204 between the cylindrical body 204 and the plunger 190 and is configured to bias the plunger 190 toward the front end 200 of the speed controller 132. The spring 192 is secured between the cylindrical body 204 and the plunger 190 by the retention screw 196, which is driven into the cylindrical body 204 at the back end 202 of the speed controller 132. As shown in FIG. 3, an inner wall of the ramped body 206 includes one or more ramped surfaces 212, such that the one or more recesses 208 are defined between the one or more ramped surfaces 212 and the cylindrical body 204. As shown in FIGS. 2 and 3, the ramped surfaces 212 are illustratively embodied as flat surfaces that are disposed at an acute angle to the longitudinal axis 122. It will be appreciated that the ramped surfaces 212 may alternatively be embodied as conical, frustoconical, parabolic, or other ramped surfaces.

In use, when a user actuates the trigger 108 of the impact tool 100, the pin 182 deflects the valve 180 from its normally closed position to permit motive fluid to flow through the passageway 188, as shown in FIG. 3. The motive fluid then flows around the speed controller 132 to the motor 102. This supply of motive fluid to the motor 102 causes the rotor 120 and the speed controller 132 (coupled to the rotor 120) to rotate about the longitudinal axis 122. As the speed controller 132 (including the masses 194) rotates, the inertia of the masses 194 attempts to move the masses 194 tangentially away from the cylindrical body 204. However, in the illustrative embodiment, the movement of the masses 194 is constrained by the ramped surface 212. The centripetal forces exerted on the masses 194 by the ramped surface 212 cause the masses 194 to move (e.g., roll or slide) upward along the ramped surfaces 212, thereby causing the masses 194 to move toward the back end 202 of the speed controller 132. Sufficient centripetal force from rotational motion of the speed controller 132 causes the masses 194 to engage the contact surface 210 of the plunger 190 and to apply a force to the plunger 190 in a direction parallel to the longitudinal axis 122 and opposite the biasing force of the spring 192.

When the one or more masses 194 push on the contact surface 210 of the plunger 190, the plunger 190 is driven toward the back end 202 of the speed controller 132. In doing so, the speed controller 132 reduces the size 220 of an orifice 214 defined between a rear end 216 of the plunger 190 and an inner wall 218 of the impact tool 100. A reduction in the size 220 of the orifice 214 restricts the amount of motive fluid that is supplied to the motor 102, which in turn reduces the speed of the motor 102. In other words, if the rotational speed of the rotor 120 exceeds a predefined threshold speed (i.e., based on characteristics of the spring 192, the weight of the masses 194, and other structural characteristics of the speed controller 132) necessary to overcome the biasing force of the spring 192, the plunger 190 reduces the size 220 of the orifice 214, thereby throttling the flow of compressed fluid through the orifice 214 and reducing the speed of the motor 102. As such, the speed controller 132 regulates the rotational speed of the motor 102 to maintain a stable or maximum speed. It will be appreciated that increasing the rotational speed of the rotor 120 results in a corresponding increase in the centripetal forces applied to the masses 194 and, generally, an increase in the force applied to the plunger 190. Accordingly, assuming the biasing force of the spring 192 is overcome and the orifice 214 is not closed (e.g., from the plunger 190 contacting the inner wall 218), an increase in the rotational speed of the rotor 120 results in a further reduction in the size 220 of the orifice 214.

Figure 4:
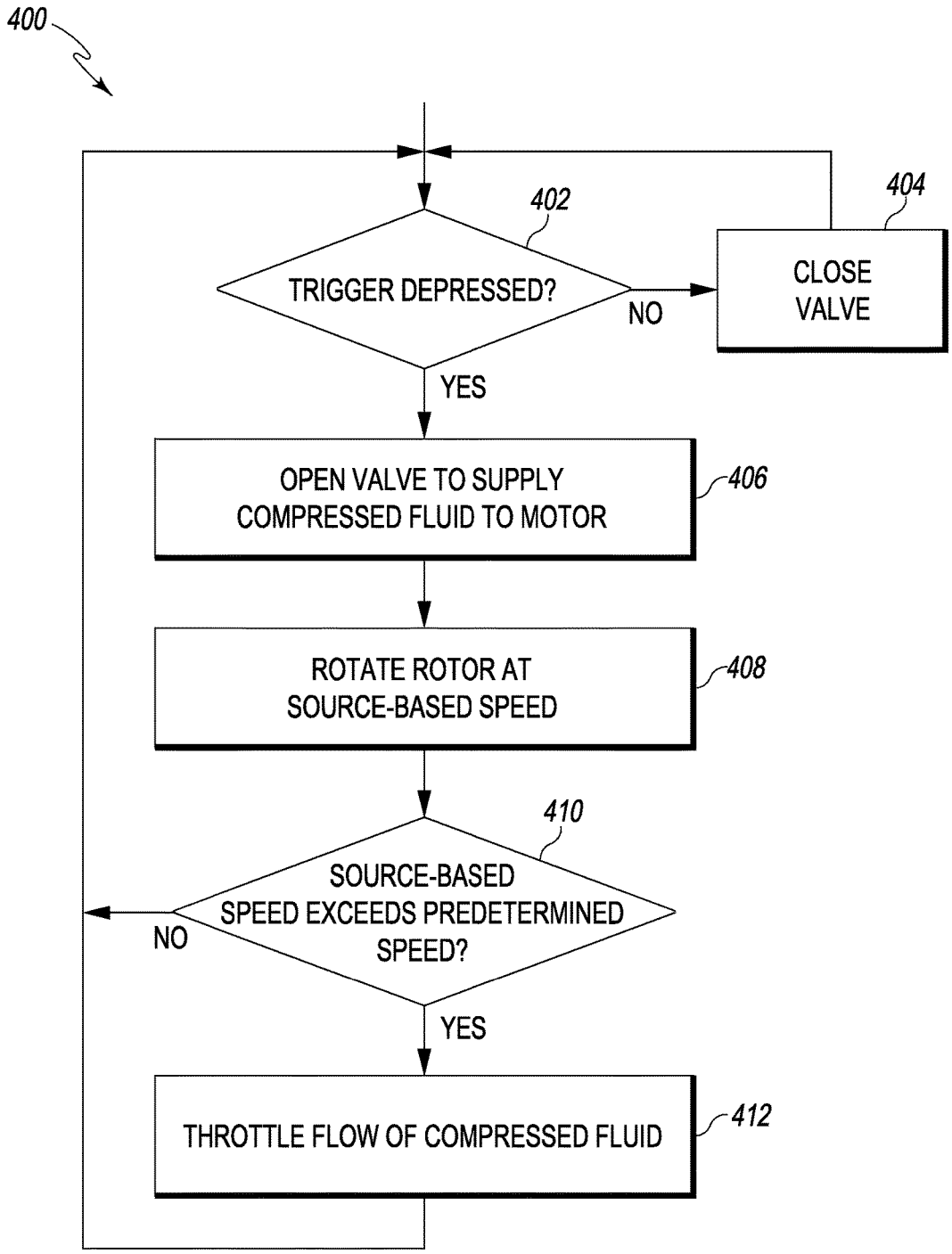
FIG. 4 is a simplified flow diagram of one illustrative embodiment of a method of controlling the impact tool of FIG. 1.

Referring now to FIG. 4, one illustrative embodiment of a method 400 of controlling the impact tool 100 of FIGS. 1-3 is shown as a simplified flow diagram. The method 400 represents one illustrative embodiment of controlling the speed of the motor 102 of an impact tool 100. The method 400 is illustrated in FIG. 4 as a number of blocks 402-412, which may be performed by various components of the impact tool 100 described above with reference to FIGS. 1-3.

The method 400 begins with block 402 in which the impact tool 100 determines whether the trigger 108 of the impact tool 100 has been depressed. If the trigger 108 has not been depressed, the method 400 proceeds to block 404 in which the impact tool 100 closes (or maintains closed) the valve 180 to ensure that motive fluid is not supplied to the motor. As discussed above, in the illustrative embodiment, the spring 184 biases the valve 180 toward a closed position when the trigger 108 is not actuated. After block 404, the method returns to block 402. If the impact tool 100 instead determines in block 402 that the trigger 108 has been actuated, the method 400 proceeds to block 406 in which the impact tool 100 opens (or maintains open) the valve 180 to supply compressed fluid to the motor 102 of the impact tool 100. As discussed above, when the trigger 108 is actuated, the valve 180 is deflected from the passageway 188 (i.e., opened), thereby permitting motive fluid to flow from the fluid inlet 186 through the passageway 188.

After opening the valve 180 in block 406, the method 400 proceeds to block 408 in which the impact tool 100 rotates the rotor 120 at a source-based speed. In other words, the rotational speed of the rotor 120 is based on the amount of motive fluid supplied to the motor 102 through the fluid inlet 186 (e.g., based on a user's compressed air supply) and through the passageway 188 and the orifice 214. After block 408, the method 400 proceeds to block 410 in which the impact tool 100 determines whether the source-based speed (i.e., the rotational speed of the rotor 120) exceeds a predetermined speed. As described above, the impact tool 100 is designed to maintain a rotational speed of the rotor 120 at or below a predetermined speed. In particular, characteristics of the spring 192, the weight of the masses 194, and other structural characteristics of the speed controller 132 may dictate the rotational speed necessary to overcome the biasing force of the spring 192 to throttle the flow of air through the orifice 214. Accordingly, in some embodiments, the predetermined speed may be defined as the speed necessary to throttle the flow of air through the orifice 214.

If the impact tool 100 determines in block 410 that the source-based speed does not exceed the predetermined speed, the method 400 returns to block 402. However, if the impact tool 100 determines that the source-based speed does exceed the predetermined speed, the method 400 proceeds to block 412 in which the impact tool 100 throttles the flow of compressed fluid to the motor 102 (i.e., in an effort to achieve the predetermined speed). That is, the excess speed of the rotor 120 results in the masses 194 overcoming the biasing force of the spring 192 and forcing the plunger 190 toward the back end 202 of the speed controller 132 to reduce the size 220 of the orifice 214 and thereby reduce the speed of the motor 102. After block 412, the method 400 returns to block 402. It will be appreciated that throttling the flow of compressed fluid in block 412 may result in over-throttling or under-throttling. Accordingly, the method 400 may be continuously repeated and a current speed of the motor 102 may oscillate about the predetermined speed.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a ball-and-cam impact mechanism comprising a hammer and an anvil, the hammer being configured to rotate about a first axis and to translate along the first axis to impact the anvil to cause rotation of the anvil about the first axis;

a motor including a rotor configured to rotate when a flow of compressed fluid is supplied to the rotor to drive rotation of the hammer of the ball-and-cam impact mechanism; and a speed controller coupled to the rotor and configured to throttle the flow of compressed fluid supplied to the rotor based on a rotational speed of the rotor; and an orifice through which the flow of compressed fluid passes, wherein the speed controller is configured to throttle the flow of compressed fluid supplied to the rotor by regulating a size of the orifice;

wherein the speed controller comprises:

a plunger movable to reduce the size of the orifice;

a spring biasing the plunger away from the orifice; and one or more masses configured to exert a force on the plunger, in response to rotation of the rotor, to overcome the spring bias;

wherein the size of the orifice is regulated by:

a reduced size of the orifice by a first amount in response to the rotational speed of the rotor being a first speed; and a second reduced size of the orifice by a second amount greater than the first amount in response to the rotational speed of the rotor being a second speed greater than the first speed;

wherein if the rotational speed of the rotor exceeds a predefined threshold speed the size of the orifice regulates the rotational speed of the motor by changing between the reduced size and the second reduced size to maintain the predefined threshold speed; and wherein the predefined threshold speed is based on the group selected from at least one of characteristics of the spring and weight of the one or more masses.

2. The impact tool of claim 1, wherein the speed controller further comprises one or more ramped surfaces, the one or more masses being in contact with the one or more ramped surfaces and with the plunger, the one or more masses being configured to move up the one or more ramped surfaces in response to centripetal forces resulting from rotation of the rotor.

3. The impact tool of claim 2, wherein:

the rotor is configured to rotate about a second axis;

the plunger is configured to translate along the second axis to move into the orifice; and the one or more ramped surfaces are disposed at an acute angle to the second axis.

4. The impact tool of claim 1, wherein the rotor is configured to rotate about a second axis that is nonparallel to the first axis.

5. The impact tool of claim 4, further comprising a drive train configured to transmit rotation from the rotor to the hammer of the ball-and-cam impact mechanism.

6. The impact tool of claim 5, wherein the drive train comprises a first bevel gear configured to rotate about an axis parallel to the first axis and a second bevel gear configured to rotate about an axis parallel to the second axis, the first bevel gear meshing with the second bevel gear.

7. The impact tool of claim 5, wherein the rotor comprises a first end coupled to the drive train and a second end coupled to the speed controller, the second end being opposite the first end.

8. The impact tool of claim 7, wherein the speed controller is configured to rotate with the rotor.

9. The impact tool of claim 1, wherein the anvil is integrally formed with an output shaft of the impact tool.

10. A method of controlling an impact tool comprising a motor and a ball-and-cam impact mechanism, the method comprising:

supplying a flow of compressed fluid through an orifice of the impact tool to cause a rotor of the motor to rotate about a first axis, such that rotation of the rotor drives rotation of a hammer of the ball-and-cam impact mechanism; and regulating a size of the orifice, using a speed controller coupled to the rotor, based on a rotational speed of the rotor, wherein the speed controller comprises, a plunger movable to reduce the size of the orifice, a spring biasing the plunger away from the orifice, and one or more masses configured to exert a force on the plunger, in response to rotation of the rotor, to overcome the spring bias;

throttling the flow of compressed fluid supplied to the rotor using the speed controller by regulating a size of the orifice;

regulating the size of the orifice is by a reduced size of the orifice by a first amount in response to the rotational speed of the rotor being a first speed; and a second reduced size of the orifice by a second amount greater than the first amount in response to the rotational speed of the rotor being a second speed greater than the first speed; wherein if the rotational speed of the rotor exceeds a predefined threshold speed the size of the orifice changes between the reduced size and the second reduced size to maintain the predefined threshold speed, wherein the predefined threshold speed is based on the group selected from at least one of characteristics of the spring and weight of the one or more masses.

11. The method of claim 10, wherein the rotor drives rotation of the hammer through a drive train coupled between the rotor and the ball-and-cam impact mechanism, the drive train including a set of bevel gears.

12. The method of claim 10, wherein the hammer rotates about a second axis that is nonparallel to the first axis.

13. The method of claim 10, wherein regulating the size of the orifice comprises moving a plunger to reduce the size of the orifice.

14. The method of claim 13, wherein moving the plunger comprises exerting a force on the plunger using one or more masses to overcome a spring bias.

15. The method of claim 14, wherein centripetal forces resulting from rotation of the rotor cause the one or more masses to exert the force on the plunger.

* * * * *